US007526888B1

(12) United States Patent
Joyce

(10) Patent No.: US 7,526,888 B1
(45) Date of Patent: May 5, 2009

(54) BREACH PLUG FOR MUZZLELOADING RIFLE

(76) Inventor: Roger D. Joyce, 708 Dowell Dr., Princeton, KY (US) 42445

( * ) Notice: Subject to any disclaimer, the term of this patent is extended or adjusted under 35 U.S.C. 154(b) by 0 days.

(21) Appl. No.: 11/612,898

(22) Filed: Dec. 19, 2006

(51) Int. Cl.
*F41C 7/00* (2006.01)
*B64D 1/04* (2006.01)

(52) U.S. Cl. ..... 42/51; 89/1.3

(58) Field of Classification Search ..... 42/51; 89/1.3

See application file for complete search history.

(56) References Cited

U.S. PATENT DOCUMENTS

| | | | | | |
|---|---|---|---|---|---|
| 173,476 | A | * | 2/1876 | Ladd | 42/76.01 |
| 3,780,464 | A | | 12/1973 | Anderson | |
| 4,222,191 | A | | 9/1980 | Lee et al. | |
| 4,232,468 | A | | 11/1980 | Chapin | |
| 4,437,249 | A | | 3/1984 | Brown et al. | |
| 4,707,942 | A | * | 11/1987 | Peters | 42/77 |
| 4,715,139 | A | | 12/1987 | Rodney, Jr. | |
| 4,888,901 | A | * | 12/1989 | French et al. | 42/51 |
| 5,010,677 | A | | 4/1991 | Verney Carron | |
| 5,133,143 | A | * | 7/1992 | Knight | 42/51 |
| 5,408,776 | A | * | 4/1995 | Mahn et al. | 42/51 |
| 5,487,232 | A | | 1/1996 | Osborne et al. | |
| 5,511,334 | A | * | 4/1996 | Ball et al. | 42/51 |
| 5,561,934 | A | * | 10/1996 | Knight | 42/51 |
| 5,642,583 | A | | 7/1997 | Ball et al. | |
| 5,755,053 | A | | 5/1998 | Oakley | |
| 5,806,227 | A | | 9/1998 | Yoder | |
| 5,860,240 | A | * | 1/1999 | Ball et al. | 42/51 |
| 5,907,920 | A | * | 6/1999 | Laney | 42/83 |
| 6,176,030 | B1 | * | 1/2001 | Ball | 42/51 |
| 6,176,031 | B1 | | 1/2001 | Ramsey | |
| 6,216,380 | B1 | * | 4/2001 | McGarity et al. | 42/51 |
| 6,219,951 | B1 | * | 4/2001 | Cate | 42/51 |
| 6,314,670 | B1 | * | 11/2001 | Rodney, Jr. | 42/51 |
| 6,343,430 | B1 | * | 2/2002 | Martel | 42/83 |
| 6,385,887 | B1 | * | 5/2002 | Johnston | 42/51 |
| 6,516,549 | B1 | | 2/2003 | Hildebrandt et al. | |
| 6,532,692 | B2 | * | 3/2003 | Cate | 42/51 |
| 6,647,653 | B1 | * | 11/2003 | Hengstenberg | 42/51 |
| 6,718,677 | B2 | | 4/2004 | Camp | |
| 6,862,828 | B1 | | 3/2005 | Joyce | |
| 7,257,917 | B1 | * | 8/2007 | Garland | 42/51 |
| 7,316,092 | B2 | * | 1/2008 | DeLeeuw | 42/51 |
| 2001/0013191 | A1 | * | 8/2001 | Cate | 42/51 |
| 2002/0035800 | A1 | | 3/2002 | Lewis | |
| 2002/0129531 | A1 | * | 9/2002 | Camp | 42/51 |
| 2002/0129534 | A1 | | 9/2002 | Hengstenberg | |
| 2004/0045208 | A1 | * | 3/2004 | Hengstenberg | 42/51 |
| 2004/0216346 | A1 | * | 11/2004 | Hengstenberg | 42/51 |
| 2007/0028499 | A1 | * | 2/2007 | DeLeeuw et al. | 42/51 |
| 2007/0137084 | A1 | * | 6/2007 | Laney et al. | 42/51 |
| 2007/0163162 | A1 | * | 7/2007 | Laney et al. | 42/51 |

* cited by examiner

*Primary Examiner*—Bret Hayes
*Assistant Examiner*—Michael D David
(74) *Attorney, Agent, or Firm*—Alexander Brackett; Middleton Reutlinger

(57) ABSTRACT

The present invention provides a two piece breech plug for converting a breech loading firearm to a muzzle loading firearm. The invention includes a forward breech plug having a powder chamber and a flash passage and a nesting rear breech plug having a primer pocket therein for accepting a primer and a flash passage that generally aligns with the flash passage of the forward breech plug.

20 Claims, 9 Drawing Sheets

BREACH PLUG FOR MUZZLELOADING RIFLE

BACKGROUND OF THE INVENTION

The present invention relates generally to muzzle-loading firearms and more specifically to an improved system and method for converting a conventional breech-loading firearm into a muzzle-loading firearm. The present invention features a two piece breech plug having a primer pocket adapted to accept a primer securely enough to allow the use of conventional rifle primers and modern propellants.

Recently, hunting and sport shooting enthusiasts have witnessed a proliferation of the use of muzzle-loading firearms, caused in large part by the advent of special "muzzle-loading weapons only" hunting seasons set aside by many states for certain species of game. As a direct result of the increased availability and use of muzzle-loading weapons, many hunters and target shooters have sought to increase the range and enhance the accuracy of these weapons.

Conventional modern muzzle-loading rifles and other muzzle-loading firearms typically comprise a barrel having an axial bore therein, a muzzle end into which a powder charge, wadding, and shot or ball are loaded, and typically a closed breech end into which the powder, wadding, and shot are pressed. Often the breech end includes a flame bore or passage from the breech end of the barrel to a nipple, onto which a percussion cap is fitted. A hammer is thence activated by depression of a trigger, striking the percussion cap and sending a flame through the flame bore to the powder charge in the breech end of the barrel, thus igniting the charge and forcing the shot or ball out of the muzzle-end of the barrel.

Modern breech-loading firearms also include a barrel having an axial bore but comprise a receiver (of varying types) at the breech end of the barrel which permits the insertion of a rifle cartridge or shotgun shell into the breech end of the barrel. The receiver is actuated to secure the cartridge or shell tightly in the breech end of the barrel. A firing pin, activated by a trigger mechanism, strikes a primer disposed in the cartridge, igniting the charge contained therein. Modern rifles utilize cartridges and receiver mechanisms for securing and sealing the cartridges in the rifle breech that permit the use of medium to slow-burning propellant powder charges to generate tremendous gas pressures over time, thereby allowing for high projectile muzzle velocities and great accuracy at distance. Ignition of these slower burning powders must be initiated by a rifle primer, or the equivalent, which provides a much hotter ignition source than the typical percussion caps used in conventional muzzle-loading weapons.

In comparison with modern rifles, muzzle-loading firearms suffer from several disadvantages. Initially, they require no small amount of time to load, and greater skill to fire accurately due to the lower muzzle velocities typically generated. Furthermore, misfires and hang-fires (delayed firing caused by slow powder ignition) are relatively common occurrences with muzzle-loading rifles, which are particularly temperamental in inclement weather due to the absorption of moisture by the powder charge. Finally muzzle-loaders must be thoroughly cleaned after each use to prevent corrosion of the barrel and clogging of the flame bore caused by the smokeless powder propellants often required for their use.

Many inventions have attempted to overcome the various drawbacks of the aforementioned muzzle-loading firearms. A variety of systems to modify a breech-loading firearm to produce a muzzle-loading firearm have been implemented. For example, U.S. Pat. No. 4,437,249 to Brown et al., incorporated herein by reference, discloses a steel breech plug adapted to be inserted into the breech end of a single barrel shotgun and includes a primer receiving bore for receiving a shotgun primer. This removable plug utilizes an o-ring to seal the plug in the breech of the shotgun barrel. Furthermore, U.S. Pat. No. 4,222,191 to Lee et al. discloses a conversion plug for use in a shotgun barrel, shaped like a shotgun shell for simple installation. The plug of this invention receives a nipple that is capable of accepting a percussion cap often used with black powder or black powder equivalent propellants.

Additionally, devices of the type disclosed by U.S. Pat. No. 6,516,549 to Hildebrandt et al. incorporate a breech plug including a primer receiving chamber and primer carrier for inserting a shotgun primer into the primer receiving chamber. This invention utilizes a type of bolt action mechanism to initiate the motion of the primer carrier.

Finally, U.S. Patent Application Publication No. US2002/035800 to Lewis teaches a breech plug having a primer pocket for converting a black powder propellant muzzle-loading gun to a smokeless powder propellant muzzle-loading gun by utilizing a primer pocket that is designed to be used with a conventional 209 shotgun primer. This invention further discloses a primer extractor for removing the spent primer from the primer pocket.

One disadvantage with the prior art inventions described herein above is their inability to operate with the modern propellant powders that are commonly employed in a wide variety of rifle cartridges. The shotgun primers used in the prior art muzzle-loading weapons are simply unsuitable for consistent ignition of the slower-burning modern powders since they do not produce sufficient heat to ignite modern rifle propellants. Furthermore, use of modern rifle propellants causes greater pressure in the breech end of the barrel than black powder or black powder equivalent propellants. This is due to the fact that these propellants have an ignition profile that causes them to generate tremendous gas pressure in the rifle barrel. Because of the speed with which these propellants ignite they quickly build up to a gas pressure peak value for a given firearm, which should not be exceeded in the interests of safety.

In order to avoid excessive pressure, the size of the propellant charge used with black powder and black powder equivalent propellants, typically denominated in grains, is much smaller than can be used with modern rifle propellants. Since the modern rifle propellants burn more slowly, a larger propellant load can be used to build up to and maintain a desired pressure level over time, which is nearly impossible to accomplish with the aforementioned black powder propellants.

When attempting to use modern rifle propellants with prior art muzzle-loading equipment, the gas pressure can cause "blowback" through the flame passage, forcing the spent primer from the primer pocket, causing hot gasses to escape from the receiver of the weapon. Furthermore, ignition of modern propellants is uncertain using percussion caps and shotgun primers.

Additionally, many of these prior art muzzle-loading firearm conversions can only be safely unloaded by discharging the weapon. This is particularly disadvantageous when a weapon is being used in the field where a hunter may not have attempted a shot after last loading the firearm. Once the conventional muzzle-loading weapon is fired the hunter has no recourse but to clean the weapon thoroughly since the corrosive nature of the propellants used will quickly ruin the ballistic performance of an un-cleaned barrel. Additionally the cleaning process for a conventional muzzle-loading rifle or shotgun is quite time consuming and not easily accomplished in the field.

Accordingly, there is a need for a muzzle-loading firearm that is capable of utilizing modern rifle propellants as well as modern rifle primers to initiate ignition thereof, that may also be safely and readily unloaded and that is easily cleaned after use.

SUMMARY OF THE INVENTION

The present invention provides a system for converting a conventional breech-loading firearm into a muzzle-loading firearm that is designed to employ a modern rifle propellant and concomitant rifle primer, or alternatively any other primer suited for igniting the powder charge being used. The invention includes a novel two piece breech plug that is capable of withstanding the gas pressures created by modern propellants while being simple to install and remove from the breech for purposes of cleaning and disarming.

Furthermore, the invention includes a rear plug having a primer pocket therein that may be independently removed from a forward plug containing a powder charge, thereby providing a user the ability to effectively and easily disarm the weapon by removing the primer from the rifle. Additionally, a blank plug is provided to replace the rear plug in the breech of the weapon thereby effectively sealing the powder charge in the breech and making accidental discharge of the weapon nearly impossible Other objects, features and advantages of the instant invention will become apparent from the detailed description of the preferred embodiments set forth herein below, in conjunction with the accompanying drawing Figures.

BRIEF DESCRIPTION OF THE DRAWING FIGURES

DETAILED DESCRIPTION OF THE PREFERRED EMBODIMENT(S)

Figure 1:
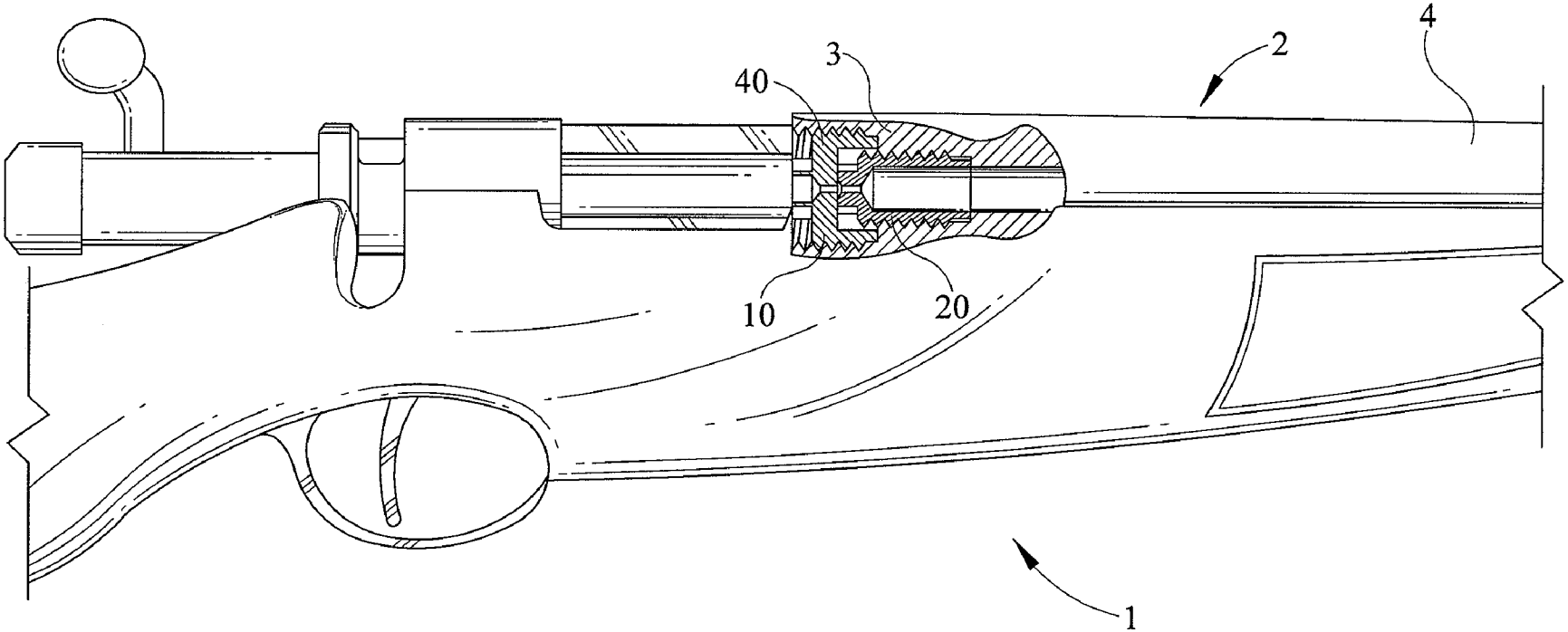
FIG. 1 is a perspective view of a firearm having a cut-away view of the breech thereof in accordance with one embodiment of the present invention.

Referring now to the drawing Figures and in accordance with one embodiment of the present invention, herein is described a novel and improved breech plug 10 for converting a firearm 1 having a barrel 2 including a breech 3 and a muzzle 4 into a muzzle-loading firearm. Breech plug 10 comprises a two piece construction including a forward plug 20 and a rear plug 40 that are secured in breech 3 to enable the operation of firearm 1 as a muzzle-loading weapon. For purposes of explication and clarity, the firearm 1 shown in the drawing Figures and referred to throughout this specification is an exemplary rifle. One of ordinary skill in the art will recognize that a wide variety of firearms may be employed in conjunction with the present invention without departing from the scope thereof.

Figure 2:
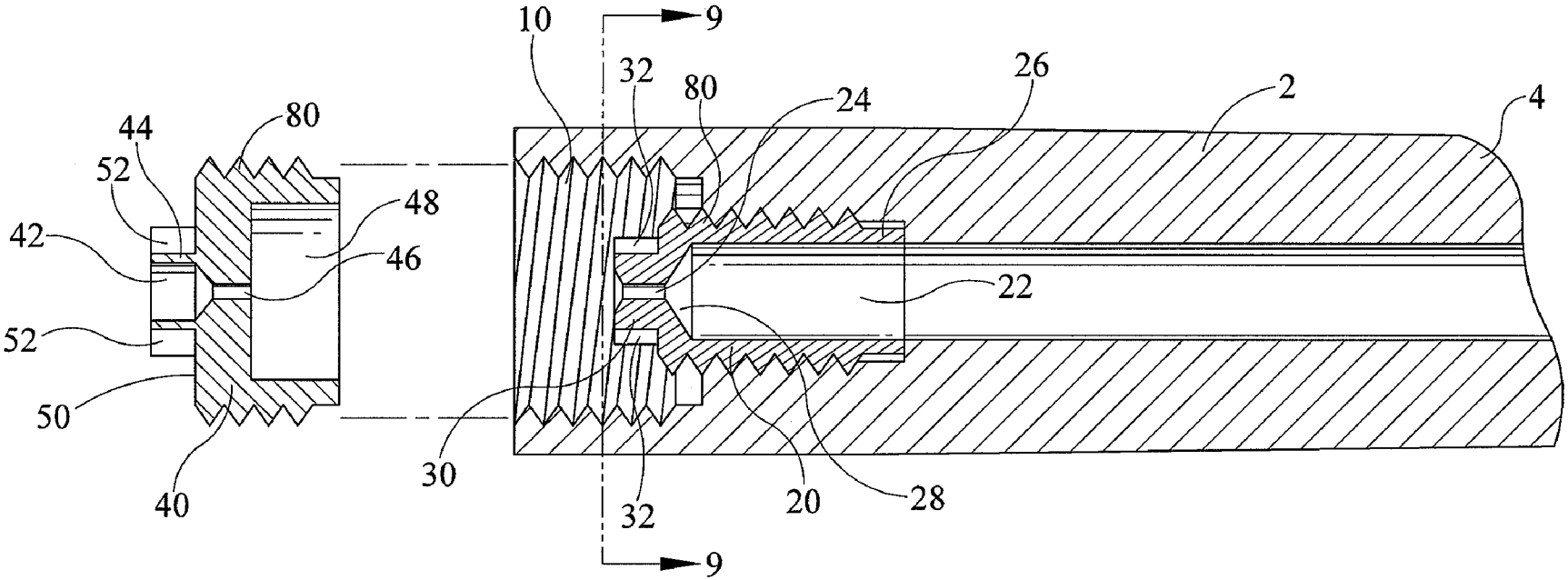
FIG. 2 is a cross-sectional view of the breech of a firearm barrel depicting a partially installed two piece breech plug in accordance with one embodiment of the present invention.
Figure 3:
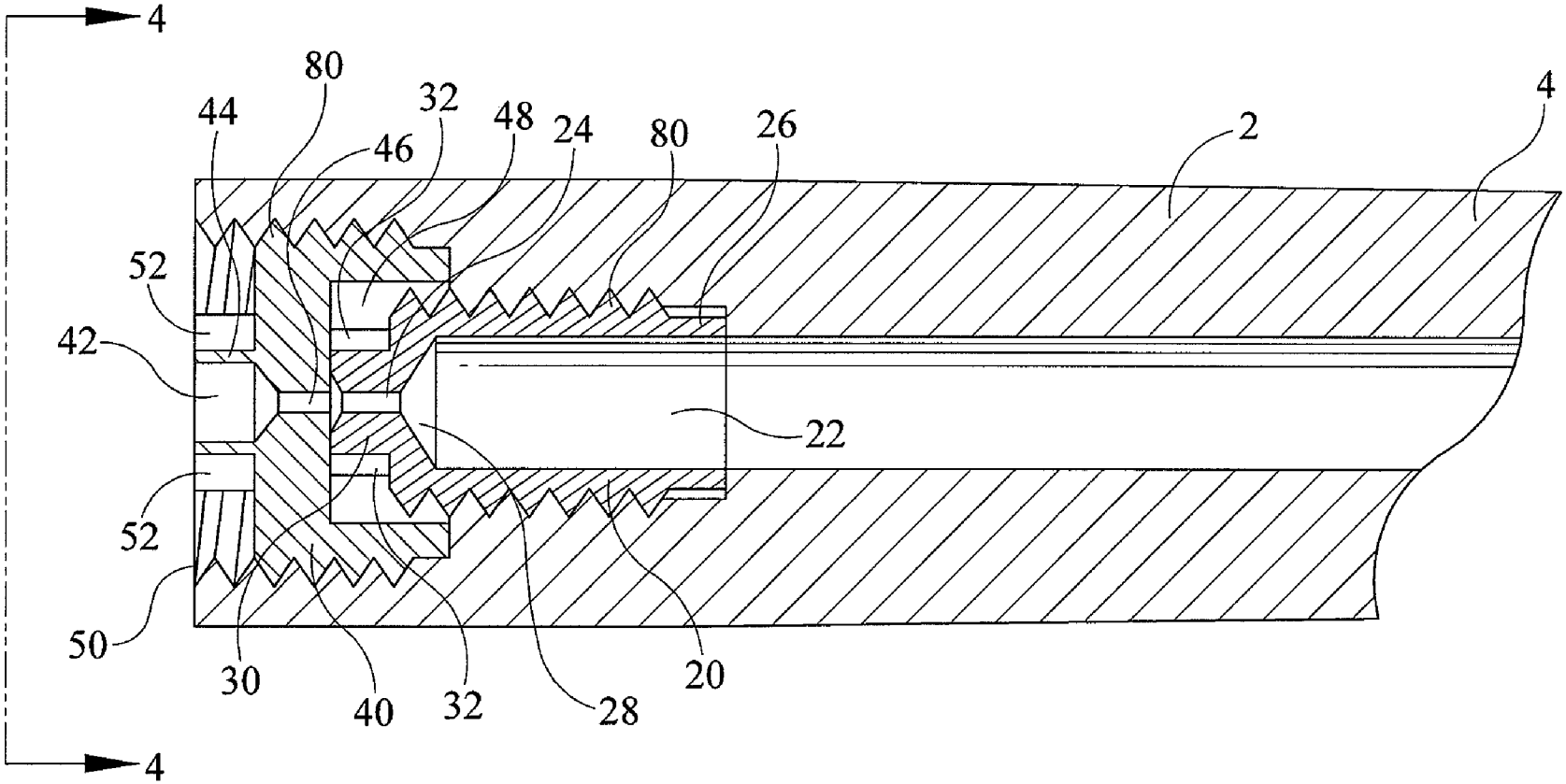
FIG. 3 is a cross-sectional view of the breech of a firearm barrel depicting an installed two piece breech plug in accordance with one embodiment of the present invention.

As best seen in FIGS. 2 and 3 forward plug 20 includes a powder chamber 22 that is generally open toward muzzle 4 and that tapers at a rear portion thereof into a flash passage 24 that acts to direct a flame and heat energy produced by the ignition of a primer to a powder charge placed in powder chamber 22. Flash passage 24 connects powder chamber 22 with a rear portion 30 of forward plug 20. While the drawing Figures depict powder chamber 22 as having a generally cylindrical forward portion 26 at a forward end thereof and a generally frusto-conical portion 28 at a rear end thereof, powder chamber 22 may be configured in a plurality of shapes and sizes to facilitate propellant ignition without departing from the scope of the present invention.

Figure 4:
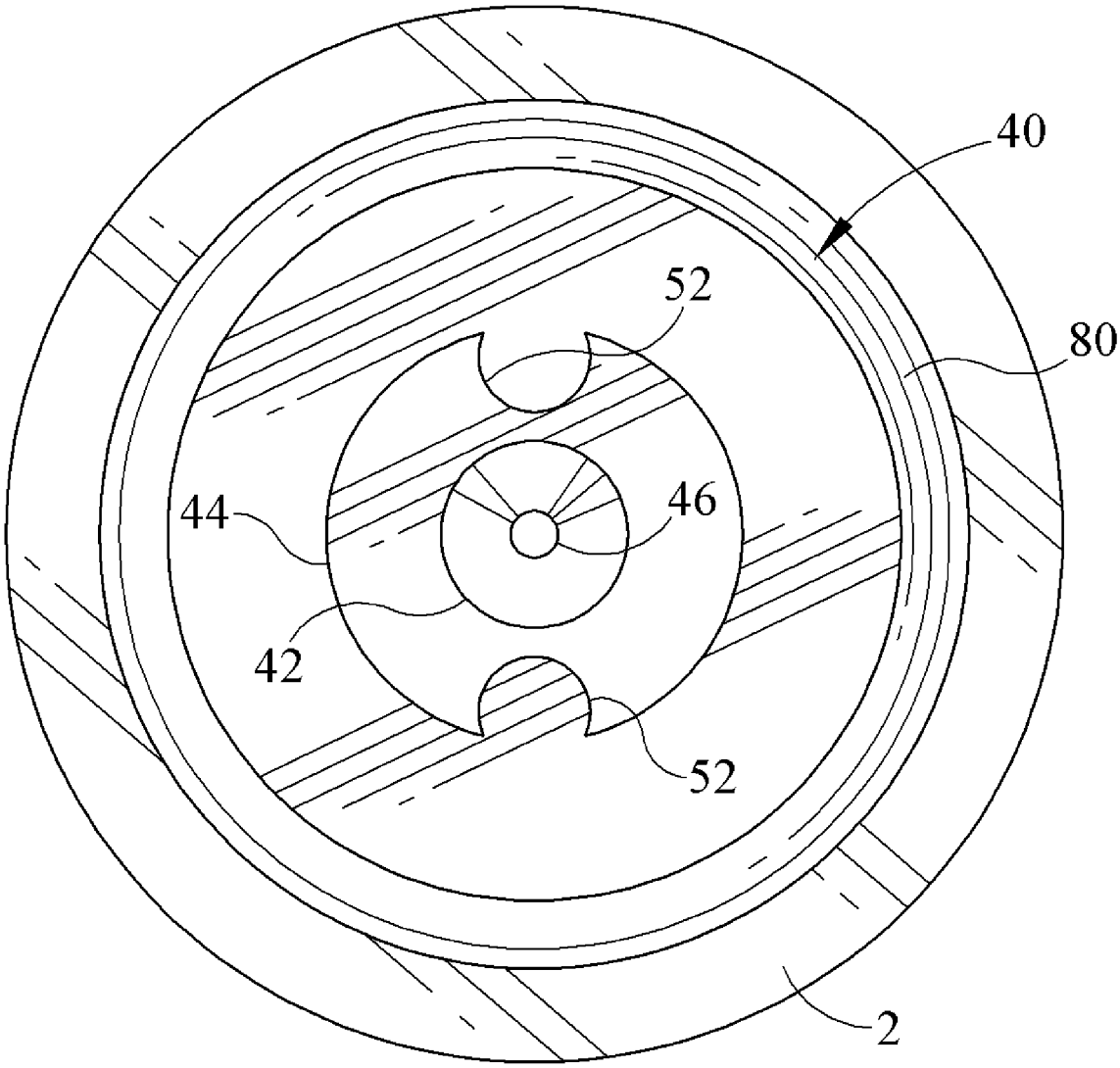
FIG. 4 is a view of a rear breech plug taken along the line 4-4 of FIG. 3 in accordance with one embodiment of the present invention.
Figure 8:
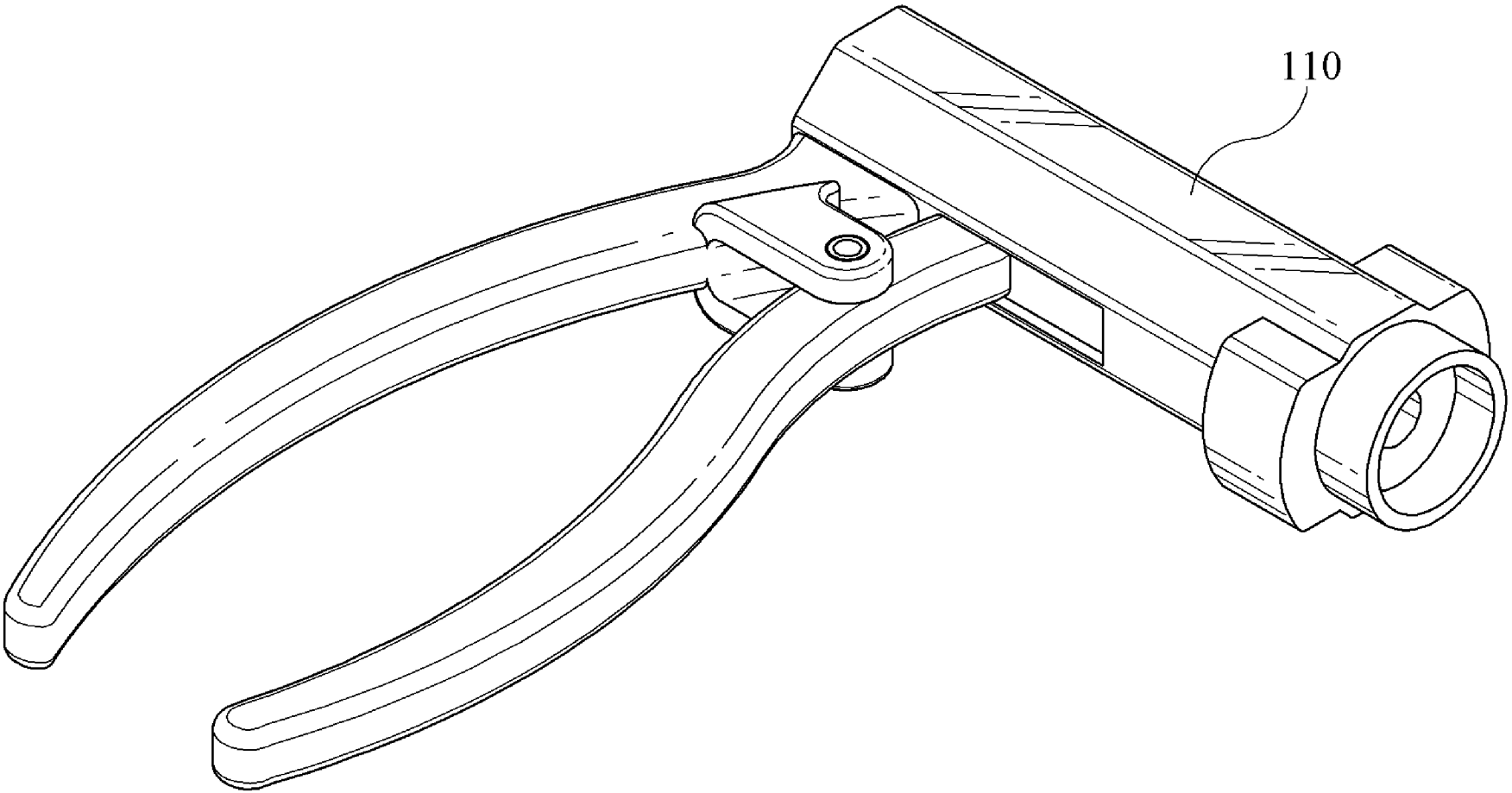
FIG. 8 is a perspective view of a primer seating tool in accordance with one embodiment of the present invention.
Figure 9:
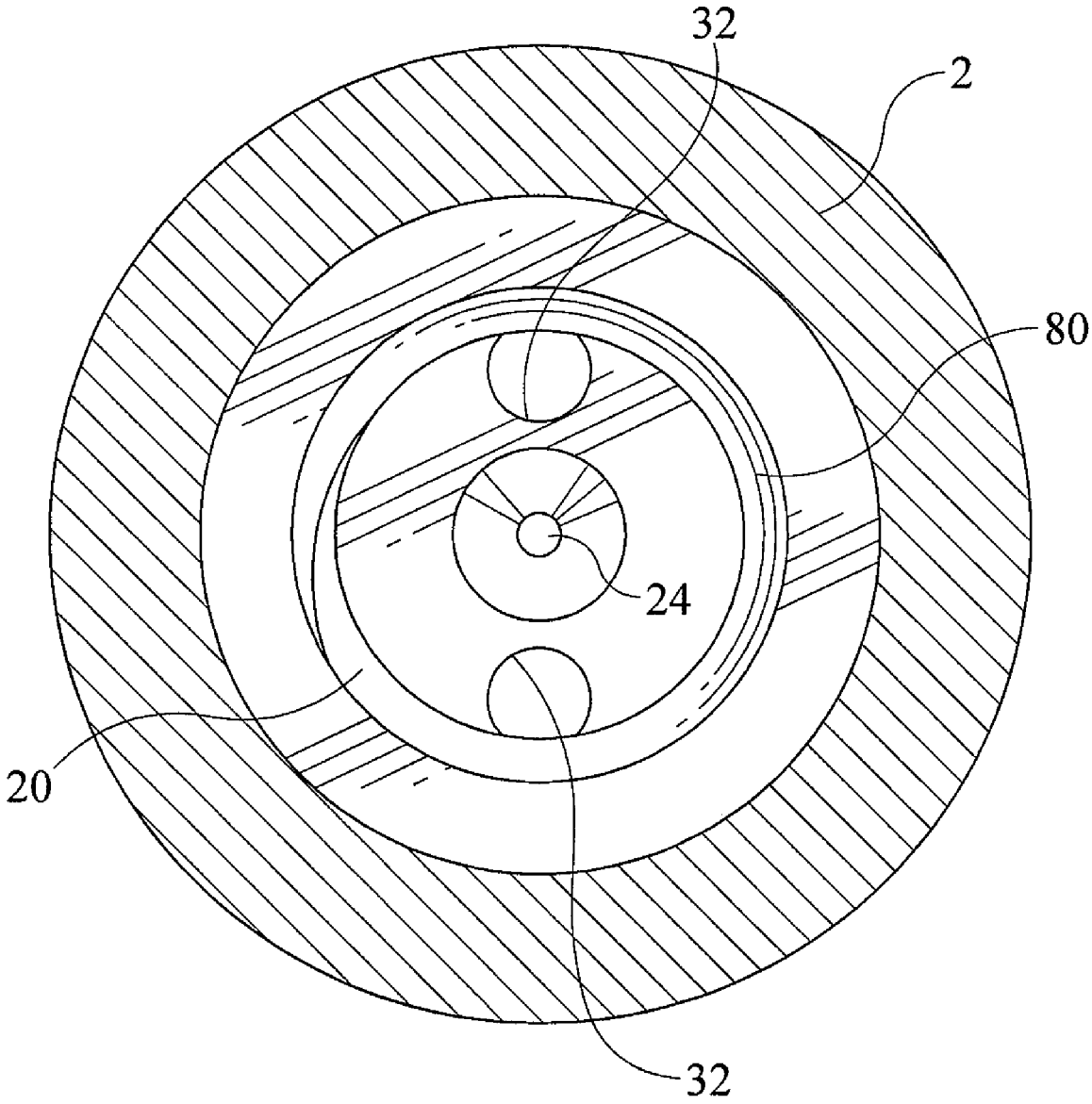
FIG. 9 is a view of the forward breech plug taken along the line 9-9 of FIG. 2.

Rear plug 40 includes a primer pocket 42 that is shaped to accept, for example, a modern rifle or shotgun primer that is securely seated therein. As seen in FIGS. 2, 3 and 4 primer pocket 42 may comprises a generally cylindrical void in a rear portion 44 of rear plug 40 having a diameter and height sized to accept a specific type of primer as required for a given propellant, propellant load, and projectile to attain a desired ballistic profile. The present invention may include a plurality of rear plugs 40 having different sized primer pockets therein such that a single firearm 1 may accommodate a plurality of different propellants and projectiles as required for a particular hunting or shooting application. In this fashion, a wide variety of different primers may be employed with the present invention including, but not limited to shotgun primer, rifle primers, and magnum rifle primers. An exemplary primer installation tool 110 is shown in FIG. 8 for seating a primer in primer pocket 42.

Rear plug 40 further comprises a flash passage 46 that connects primer pocket 42 to an interior portion 48 of rear plug 40 to direct a flame (and concomitant heat) produced by the ignition of a primer to interior portion 48 of rear plug 40.

Figure 6:
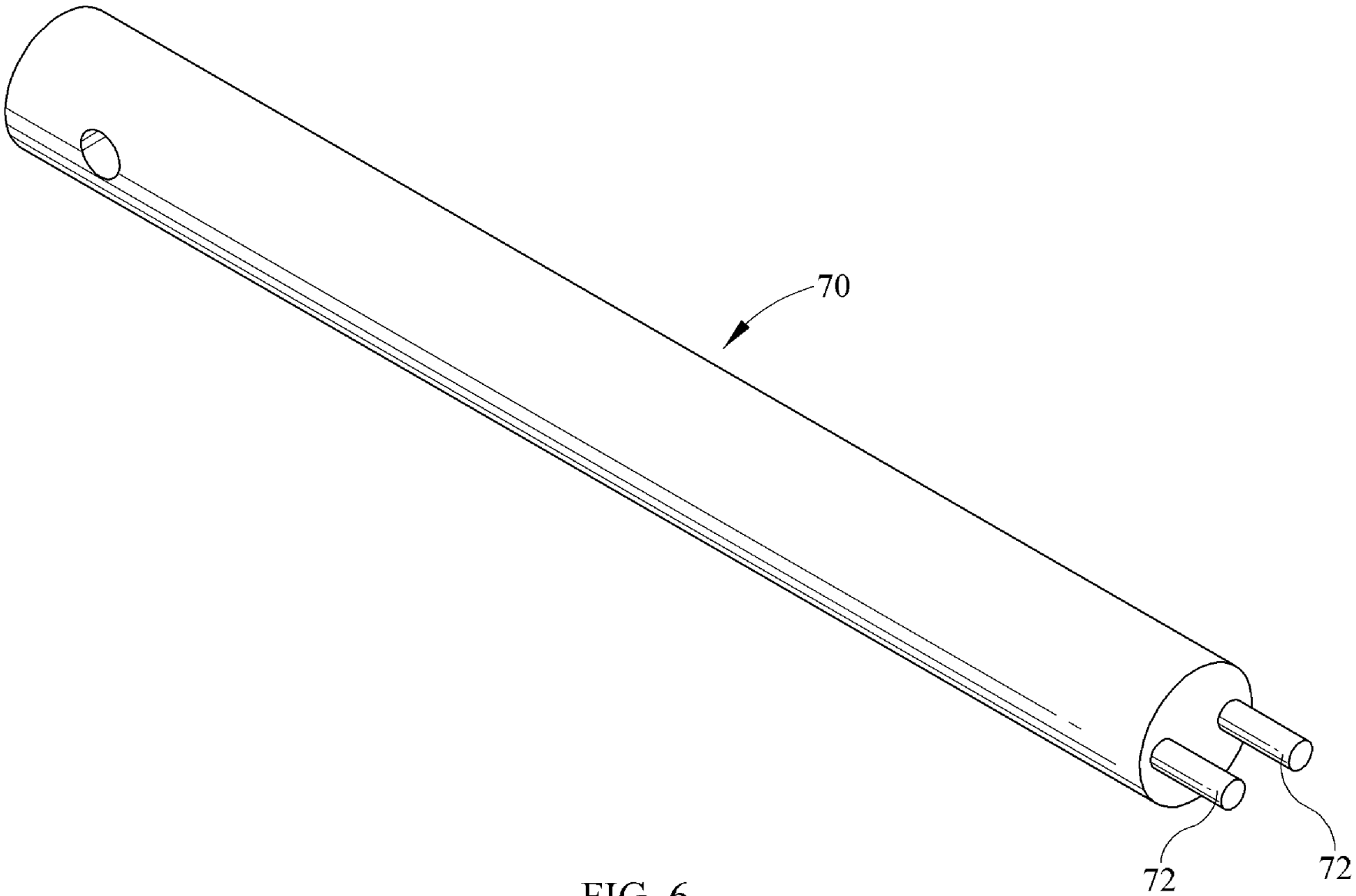
FIG. 6 is a perspective view of an insertion and removal tool in accordance with one embodiment of the present invention.

In one embodiment of the present invention rear portion 44 of rear plug 40 is formed in the shape of an annulus that depends outwardly from a face 50 of rear plug 40. The annulus shaped rear portion 44 includes an inner circumference that defines primer pocket 42 and an exterior circumference that includes a pair of spaced notches 52 that are adapted to accept a pair of protrusions 72 extending outwardly from an insertion and removal tool 70, as shown in FIG. 6. The shape of notches 52 and the mating protrusions 72 of insertion and removal tool 70 may be any of a plurality of shapes. In one embodiment of the invention and as shown in FIG. 4, notches 52 are semi-cylindrical in shape such that spaced protrusions 72 may be generally cylindrical to easily engage notches 52.

In a similar fashion rear portion 30 of forward plug 20 may form an annular portion having an inner circumference defining flash passage 24 and an outer circumference that is smaller than the generally cylindrical forward portion 26 thereof. Rear portion 30 of forward plug 20 may further comprise a pair of spaced notches 32 that are shaped to engage protrusions 72 of insertion and removal tool 70 to facilitate removal of forward plug 20 for cleaning of firearm 1. In one embodiment of the invention notches 32 of forward plug 20 and notches 52 of rear plug 40 are spaced equidistantly such that each may be removed by the same insertion and removal tool 70.

Figure 5:
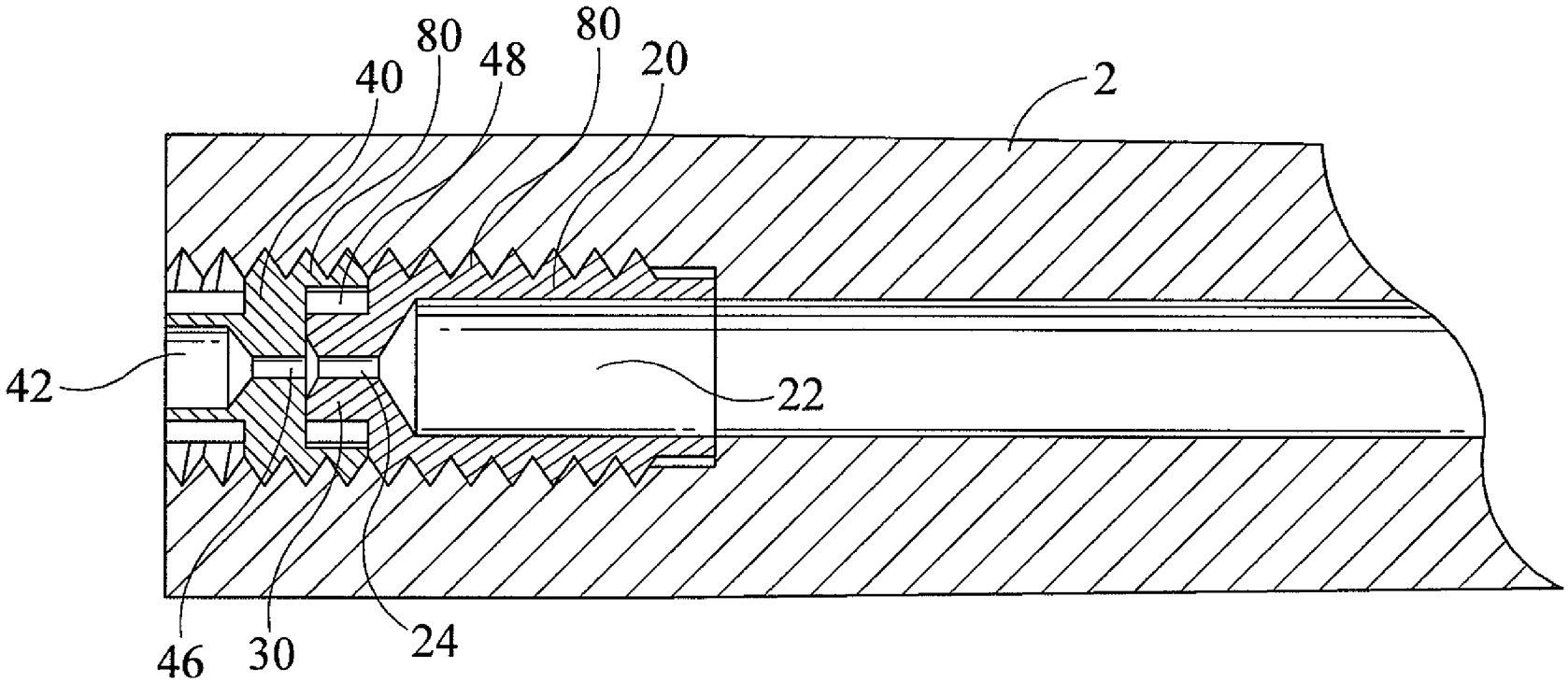
FIG. 5 is a cross-sectional view of the breech of a firearm barrel depicting an installed two piece breech plug in accordance with one embodiment of the present invention.

In a yet further embodiment of the invention as best seen in FIGS. 2, 3 and 5 rear portion 30 of forward plug 20 is shaped to be inserted snugly into interior portion 48 of rear plug 40 so that rear portion 30 nests within interior portion 48. This feature of the invention provides very close alignment of flash passages 24 and 46 of forward and rear plugs 20 and 40 respectively, thereby permitting no loss of ignition flame due to poor alignment of flame passages 24 and 46. This feature of the invention further provides for enhanced breech plug 10 strength at the point where forward plug 20 and rear plug 40 mate.

As best seen in FIGS. 2, 3 and 5 both forward plug 20 and rear plug 40 may include a plurality of helical threads 80 disposed about their exterior surfaces that engage mating threads provided in the bore of barrel 2 proximate breech 3. This feature of the invention permits easy installation and removal of forward plug 20 and rear plug 40.

FIG. 2 depicts an embodiment of the present invention wherein rear plug 40 helical threads 80 are left-handed threads while the helical threads 80 of forward plug 20 are right-handed. In this embodiment of the invention, rear plug 40 is installed and removed by turning the plug oppositely of the direction required to install or remove forward plug 20. This feature of the invention makes it impossible to accidentally turn out both plugs simultaneously in the event that forward and rear plugs 20 and 40 become stuck together after repeated use. This feature makes the system of the present invention quite safe, since it will be virtually impossible to accidentally remove a forward plug 20 that is packed with a powder charge and projectile. In an alternative embodiment of the present invention, rear plug 40 is provided with right handed threads while forward plug 20 is provided with left-handed threads.

In a yet further embodiment of the invention the thread diameter of forward plug 20 is smaller than the thread diameter of rear plug 20. In this embodiment of the invention, two different mating thread diameters must be machined in the bore of barrel 2 to accept the two thread diameters of plugs 20 and 40. However, this embodiment of the invention prohibits improper installation of the two piece breech plug 10, since forward and rear plugs 20 and 40 will only fit in breech 3 in one way.

Figure 7:
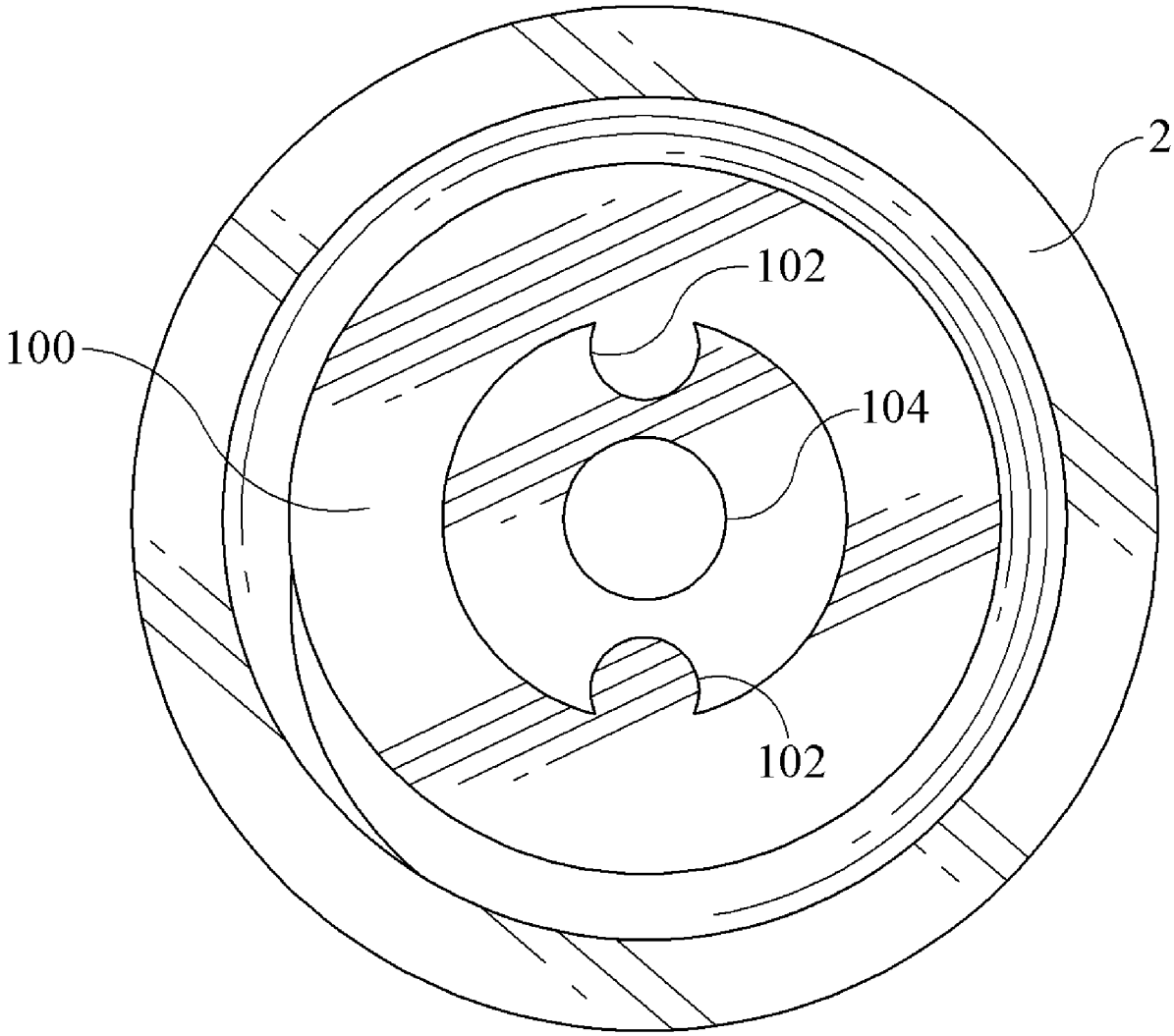
FIG. 7 is a side view of a blank forward breech plug in accordance with one embodiment of the present invention.

Additionally, as shown in FIG. 7 a blank rear plug 100 may be provided with the present invention. Blank plug 100 includes notches 102 for ready insertion and removal and is intended to enable a user to disarm firearm 1 without discharging it. Blank plug 100 may further comprise a firing pin recess 104 in a central portion thereof that provides clearance for a firing pin of firearm 1 in the event that the firearm trigger is accidentally pulled. This feature of the invention prevents accidental damage to the firearm 1 firing pin, since the pin can't strike blank plug 100.

With the firearm loaded—a powder charge in powder chamber 22, a primer seated in primer pocket 42, and a projectile (not shown) seated on the forward portion 26 of plug 20—a hunter may disarm firearm 1 by removing the rear plug 40 using insertion and removal tool 70 and then replace it with blank plug 100. This feature of the invention prohibits any firing of the weapon since there is no access to the powder charge and further, keeps the powder charge free of moisture and other contaminants. Once it is necessary to use firearm 1, the user simply replaces blank plug 100 with rear plug 40, including a suitable primer seated in primer pocket 42.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A two piece breech plug for converting a breech loading firearm having a barrel with a muzzle end and a breech end into a muzzle-loading firearm comprising:

a breech plug comprising:

a forward plug having a powder chamber open towards the muzzle end of said firearm at a forward portion thereof and a flash passage in a rear portion thereof in fluid communication with said powder chamber, said rear portion having a pair of spaced notches therein for accepting a pair of spaced protrusions of an insertion and removal tool; and a rear plug having a primer pocket at a rear end thereof for accepting a primer and a flash passage between said primer pocket and an interior portion of said rear plug wherein the flash passages of said forward and rear plugs generally align when said plugs are secured in said breech.

2. A two piece breech plug as claimed in claim 1 further comprising:

a plurality of helical threads disposed about a generally cylindrical exterior surface of said forward plug and said rear plug for securing said forward and rear plugs, respectively, in the breech of said firearm barrel.

3. A two piece breech plug as claimed in claim 2 wherein said forward plug has a thread diameter smaller than said rear plug thread diameter.

4. A two-piece breech plug as claimed in claim 2 wherein said helical threads of said forward plug are left-handed threads and wherein said helical threads of said rear plug are right-handed threads.

5. A two-piece breech plug as claimed in claim 2 wherein said helical threads of said forward plug are right-handed threads and wherein said helical threads of said rear plug are left-handed threads.

6. A two piece breech plug as claimed in claim 1 wherein said rear plug further comprises a rear portion having a pair of spaced notches therein for accepting a pair of spaced protrusions of an insertion and removal tool.

7. A two piece breech plug as claimed in claim 6 wherein said rear plug rear portion is an annulus surrounding said primer pocket.

8. A two piece breech plug as claimed in claim 6 wherein the pair of spaced notches in said rear portion are semi-cylindrical.

9. A two piece breech plug as claimed in claim 1 wherein said forward plug rear portion is an annulus shaped to nest in the interior portion of said rear plug.

10. A two piece breech plug as claimed in claim 1 wherein the said pair of spaced notches in said rear portion are semi-cylindrical.

11. A two piece breech plug for converting a breech loading firearm having a barrel with a muzzle end and a breech end into a muzzle-loading firearm comprising:

a forward plug having a powder chamber in fluid communication with a rear annular portion via a flash passage therebetween and a pair of spaced notches in said annular portion; and a rear plug having a primer pocket in a rear portion thereof, a generally cylindrical interior portion, and a flash passage situated between said interior portion and said primer pocket, wherein said annular portion of said forward plug engages said interior portion of said rear plug.

12. A two piece breech plug as claimed in claim 11 wherein the flash passages of said forward plug and said rear plug are closely aligned.

13. A two piece breech plug as claimed in claim 11 further comprising:

a plurality of helical threads disposed about an outer surface of both the forward plug and the rear plug for securing said plugs in the barrel of said firearm.

14. A two piece breech plug as claimed in claim 13 wherein said helical threads of said forward plug are left-handed threads and wherein said helical threads of said rear plug are right-handed threads.

15. A two piece breech plug as claimed in claim 13 wherein said helical threads of said forward plug are right-handed threads and wherein said helical threads of said rear plug are left-handed threads.

16. A two piece breech plug as claimed in claim 11 further comprising:

a pair of spaced notches in the rear portion of said rear plug for engaging a pair of spaced protrusions of an insertion and removal tool.

17. A two piece breech plug as claimed in claim 11 further comprising:

a blank plug having a generally cylindrical interior portion for engaging said annular portion of said forward plug.

18. A two piece breech plug as claimed in claim 11 wherein said primer pocket is sized to accept a shotgun primer.

19. A two piece breech plug as claimed in claim 11 wherein said primer pocket is sized to accept a rifle primer.

20. A two piece breech plug as claimed in claim 11 wherein said primer pocket is sized to accept a magnum rifle primer.

* * * * *